US008091718B2

(12) United States Patent
Yu et al.

(10) Patent No.: US 8,091,718 B2
(45) Date of Patent: Jan. 10, 2012

(54) CAP FOR SEALING NIPPLE

(75) Inventors: Kuo-Hung Yu, Yilan (TW); Tien-Ho Wei, Banciao (TW); Linda H. Pouliot, San Mateo, CA (US); Robert W. Strickler, San Jose, CA (US); Daniel K. Harden, Palo Alto, CA (US)

(73) Assignee: 0875505 B.C. Ltd., Kelowna, BC (CA)

( * ) Notice: Subject to any disclaimer, the term of this patent is extended or adjusted under 35 U.S.C. 154(b) by 52 days.

(21) Appl. No.: 12/478,698

(22) Filed: Jun. 4, 2009

(65) Prior Publication Data

US 2010/0308004 A1 Dec. 9, 2010

(51) Int. Cl.
*A61J 9/08* (2006.01)

(52) U.S. Cl. ..... 215/11.6; 215/11.1

(58) Field of Classification Search ..... 215/11.1, 215/11.6; 606/236
See application file for complete search history.

(56) References Cited

U.S. PATENT DOCUMENTS

| | | | | | |
|---|---|---|---|---|---|
| 2,167,284 | A | * | 7/1939 | Sauder | 215/11.6 |
| 2,434,611 | A | * | 1/1948 | Hamiel | 215/11.5 |
| 3,273,703 | A | * | 9/1966 | Stribley | 206/471 |
| 3,531,009 | A | * | 9/1970 | Saperstein | 215/11.6 |
| 3,779,413 | A | * | 12/1973 | Pickerell et al. | 215/11.6 |
| 4,015,740 | A | | 4/1977 | Hurst | |
| 4,706,827 | A | * | 11/1987 | Cabernoch et al. | 215/11.3 |
| 4,895,264 | A | * | 1/1990 | Phlaphongphanich | 215/11.1 |
| 5,318,191 | A | | 6/1994 | Pomales et al. | |
| 5,704,500 | A | * | 1/1998 | Hoffmann et al. | 215/11.6 |
| 5,881,893 | A | | 3/1999 | Manganiello | |
| 6,042,850 | A | * | 3/2000 | Ida et al. | 426/2 |
| 6,171,623 | B1 | | 1/2001 | Gaylor et al. | |
| 6,398,049 | B1 | | 6/2002 | Cote | |
| 7,287,657 | B1 | | 10/2007 | Rodriguez | |
| 2004/0256345 | A1 | | 12/2004 | Lundquist | |
| 2006/0006128 | A1 | * | 1/2006 | Resendiz Sanudo | 215/11.6 |
| 2006/0144810 | A1 | * | 7/2006 | Mallet | 215/11.1 |
| 2007/0012643 | A1 | | 1/2007 | McKiddy | |
| 2008/0083692 | A1 | | 4/2008 | Strickler et al. | |

FOREIGN PATENT DOCUMENTS

WO 9709956 A1 3/1997

OTHER PUBLICATIONS

PCT/US2010/037515, International Search Report and Written Opinion, 8 pages.

* cited by examiner

*Primary Examiner* — Sue Weaver
(74) *Attorney, Agent, or Firm* — Patent Law Group LLP; David C. Hsia

(57) ABSTRACT

A cap includes a cavity for receiving the rounded tip of a nipple. The cavity narrows from an open end to a neck, and widens from the neck to a closed end. The neck forms an interference fit with the rounded tip, and the interference fit forms a sealed compartment in the cap that encloses an aperture in the rounded tip.

8 Claims, 3 Drawing Sheets

CAP FOR SEALING NIPPLE

CROSS REFERENCE TO RELATED APPLICATION

This application is related to U.S. patent application Ser. No. 12/478,695, entitled "Natural and Modular Infant Feeding Container," which is concurrently filed on Jun. 4, 2009 and incorporated herein by reference.

FIELD OF INVENTION

The present invention relates to a cap that prevents leakage, and more specifically to a cap for a baby bottle nipple.

DESCRIPTION OF RELATED ART

A baby bottle usually has a cover that protects the nipple or teat from dust and other contaminants. The cover may have a flat inner surface against which the top of the nipple may press against to prevent leakage. However, a liquid may still flow from the nipple in such an arrangement when the bottle is turned upside down.

SUMMARY

In some embodiments of the invention, a cap includes a cavity that narrows from an open end to a neck, and widens from the neck to a closed end. The neck forms an interference fit with the rounded tip of a nipple, and the interference fit forms a sealed compartment in the cap that encloses an aperture in the rounded tip. When a fluid leaks from the aperture, the fluid reduces the volume of the sealed compartment and increases the air pressure in the sealed compartment. The increased air pressure then prevents any further leakage from the aperture.

BRIEF DESCRIPTION OF THE DRAWINGS

Use of the same reference numbers in different figures indicates similar or identical elements.

DETAILED DESCRIPTION

Figure 1:
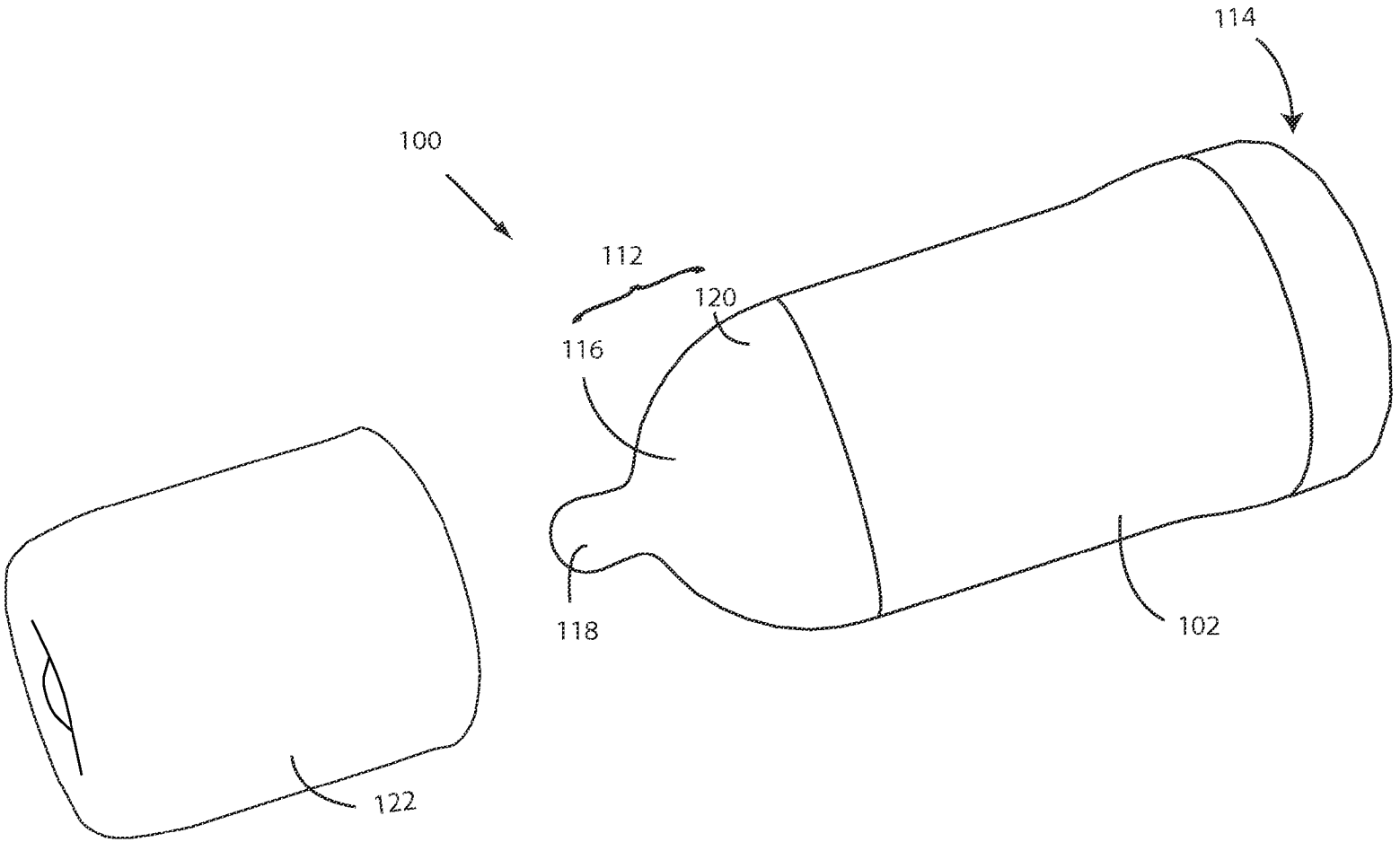
FIG. 1 illustrates a cover that prevents leakage from an infant feeding container.

FIG. 1 illustrates a cover 122 that prevents leakage from a container 100 (e.g., a baby bottle) in some embodiments of the invention. Although cover 122 is described in relations to container 100, the cover may be adopted by one skilled in the art for use with conventional baby bottles with conventional nipples without deviating from the spirit of the embodiments of the inventing.

Container 100 includes a generally cylindrical body 102 with a top 112 and a bottom cap 114. Top 112 and bottom cap 114 may be removable from body 102 to allow container 100 to be filled with a liquid. Top 112 has a pliant dome 116 with a ducted nipple 118 at the crest, and a rigid skirt 120. Dome 116 is formed in the approximate shape of a breast. Dome 116 is greater in size than a conventional baby bottle nipple. When filled with a warm liquid, dome 116 provides soft and warm facial contact to an infant during feeding. For more details related to container 100, please refer to related U.S. patent application Ser. No. 12/478,695, entitled "Natural and Modular Infant Feeding Container," which is concurrently filed and incorporated by reference.

Figure 2:
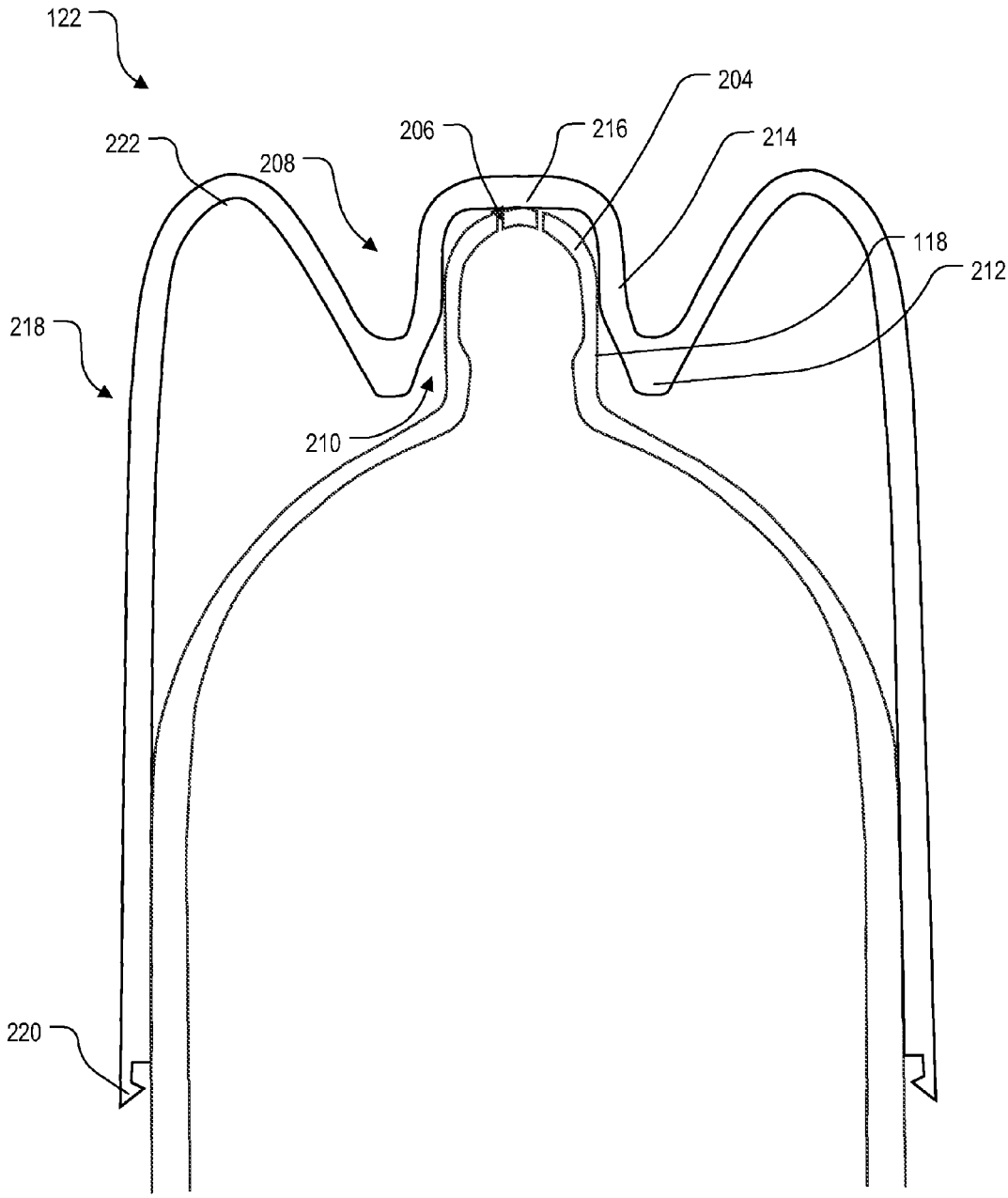
FIG. 2 illustrates a cross-section view of the cover and part of the infant feeding container along their lengths.

FIG. 2 illustrates the cross section of cover 122 and part of container 100 along their lengths in some embodiments of the invention. Nipple 118 has a rounded tip 204 that defines one or more apertures 206 (only one is labeled for clarity) for dispensing a liquid.

Cover 122 includes an annular cap 208 for covering rounded tip 204. Cap 208 defines a cavity 210 with a cross-section that narrows from an open end 212 to a neck 214, and remains constant or expands slightly from the neck to a closed end 216. The narrowing of cavity 210 from open end 212 to neck 214 provides a chamfered entrance that guides rounded tip 204 into the cap 208. The angle A from open end 212 to neck 214 is smaller than 45 degrees. For example, the angle A from open end 212 to neck 214 is 20 degrees.

Neck 214 is sized for an interference fit with the side of rounded tip 204. Neck 214 extends vertically or slightly outward before joining closed end 216. For example, the angle from neck 214 to closed end 216 is 91 degrees. The joint between neck 214 and closed end 216 may be rounded. Closed end 216 has an inner flat surface that helps to seal apertures 206 when the top of rounded tip 204 is pressed against the inner flat surface.

Cover 122 further includes an annular apron 218 concentric with the cap for covering the remaining portion of the nipple. Apron 218 is generally tubular. Apron 218 has an open end 220 for receiving container 100, and a closed end 222 that curves inward at an angle before joining open end 212 of cap 208.

Figure 3:
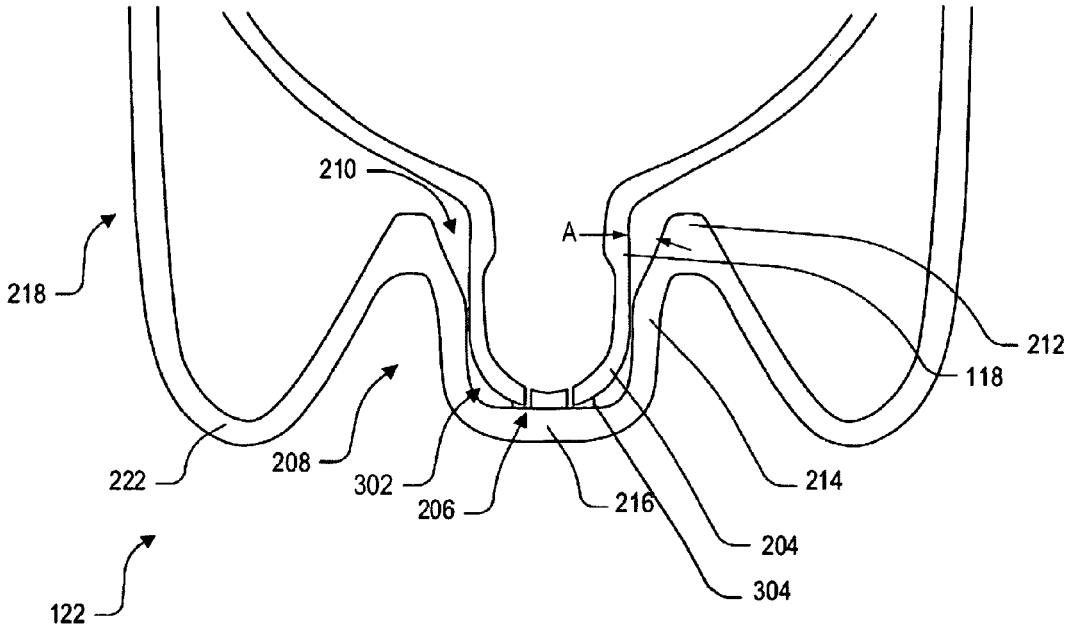
FIG. 3 illustrates shows the cover turned upside down and a nipple of the infant feeding container inserted into the cover, all arranged in accordance with embodiments of the invention.

FIG. 3 shows cover 122 turned upside down and nipple 118 of container 100 inserted into the cover in some embodiments of the invention. Specifically, rounded tip 204 of nipple 118 is inserted into cap 208. Neck 214 provides interference at the side of rounded tip 204 to form a sealed compartment 302 in cap 208 that enclosed apertures 206. Note that nipple 118 may be enlarged when the container is filled with liquid. The enlargement creates a tighter seal in the interference fit between neck 214 and the side of rounded tip 204.

The liquid content may leak from apertures 206 even when the top of rounded tip 204 is pressed against the inner flat surface of closed end 216. However, sealed compartment 302 helps to prevent further leakage. As a liquid 304 enters into sealed compartment 302 from apertures 206, the volume of the sealed compartment 302 decreases and therefore the air pressure inside the seal compartment increases. The increased air pressure prevents liquid 304 from leaking further from container 100.

Various other adaptations and combinations of features of the embodiments disclosed are within the scope of the invention. Numerous embodiments are encompassed by the following claims.

What is claimed is:

1. A cap for covering a nipple having a rounded tip defining an aperture, the cap defining a cavity comprising an open end, a neck, and a closed end, wherein the cavity narrows from the open end to the neck and remains constant or widens from the neck to the closed end, the closed end comprises a flat inner surface against which the top of the rounded tip presses, and the neck forms an interference fit with the side of the rounded tip.

2. The cap of claim 1, wherein a first angle from the open end to the neck is smaller than 45 degrees.

3. The cap of claim 2, wherein the cap has a circular cross-section along its length.

4. A system, comprising:

a nipple comprising a rounded tip, the rounded tip defining an aperture; and a cover comprising a cap for covering the rounded tip, the cap defining a cavity comprising an open end, a neck, and a closed end, the cavity narrowing from the open end to the neck and remaining constant or widening from the neck to the closed end;

wherein the closed end comprises a flat inner surface against which the top of the rounded tip presses, and the neck forms an interference fit with the rounded tip, and the interference fit forms a sealed compartment in the cap that encloses the aperture.

5. The system of claim 4, wherein a fluid leaking from the aperture reduces the volume of the sealed compartment and increases the air pressure in the sealed compartment, and the increased air pressure prevents the liquid from leaking further from the aperture.

6. The system of claim 5, wherein a chamfer angle of the cap from the open end to the neck is smaller than 45 degrees.

7. The system of claim 6, wherein the cap is annular.

8. The system of claim 7, wherein the cover further defines an annular apron concentric with the cap, the cover covering another portion of the nipple.

* * * * *